US005836661A

United States Patent [19]

Oldorf

[11] Patent Number: 5,836,661

[45] Date of Patent: Nov. 17, 1998

[54] PACKAGE DISPENSER

[75] Inventor: Dennis L. Oldorf, Scottsdale, Ariz.

[73] Assignee: Lil' Drug Store Products, Inc., Cedar Rapids, Iowa

[21] Appl. No.: 717,851

[22] Filed: Sep. 23, 1996

[51] Int. Cl.[6] ..... A47F 1/08

[52] U.S. Cl. ..... 312/42; 312/290; 312/35; 229/243; 221/197; 206/469

[58] Field of Search ..... 312/35, 42, 211, 312/290; 221/197; 11/287; 206/531, 532, 539, 469, 815; 229/243

[56] References Cited

U.S. PATENT DOCUMENTS

| | | | |
|---|---|---|---|
| D. 327,991 | 7/1992 | Oldorf . | |
| D. 329,159 | 9/1992 | Oldorf . | |
| D. 329,343 | 9/1992 | Oldorf . | |
| 348,164 | 8/1886 | Judson | 312/290 X |
| 536,544 | 3/1895 | Schmidt . | |
| 1,673,711 | 6/1928 | Richeson . | |
| 1,673,812 | 6/1928 | Dunn | 312/42 |
| 1,972,406 | 9/1934 | Marsh . | |
| 1,974,926 | 9/1934 | Marsh . | |
| 1,999,021 | 4/1935 | Marsh . | |
| 2,582,155 | 1/1952 | Pedersen | 312/42 |
| 2,597,940 | 5/1952 | Locke | 221/197 |
| 2,785,843 | 3/1957 | Shaw . | |
| 3,147,856 | 9/1964 | Lightner et al. | 229/243 X |
| 3,164,298 | 1/1965 | Repko . | |
| 3,309,206 | 3/1967 | Daniels . | |
| 3,568,911 | 3/1971 | Debout . | |
| 3,637,130 | 1/1972 | Farquhar | 229/243 |
| 4,170,325 | 10/1979 | Pawlowski et al. . | |
| 4,199,078 | 4/1980 | Ramirez . | |
| 4,382,526 | 5/1983 | Stone . | |
| 4,497,732 | 2/1985 | Milia . | |
| 4,574,951 | 3/1986 | Weaver | 206/469 X |
| 4,702,409 | 10/1987 | Osborne | 206/815 X |
| 4,767,022 | 8/1988 | Oldorf | 222/197 X |
| 4,850,511 | 7/1989 | Kral et al. | 312/42 X |
| 5,209,354 | 5/1993 | Thornhill et al. | 206/469 |
| 5,322,185 | 6/1994 | Leight | 221/287 X |

FOREIGN PATENT DOCUMENTS

| | | | |
|---|---|---|---|
| 914964 | 10/1946 | France | 312/42 |
| 1194972 | 11/1959 | France | 312/42 |
| 1401336 | 4/1965 | France | 229/243 |
| 387473 | 10/1962 | Germany . | |
| 101042 | 2/1965 | Germany . | |
| 41846 | 10/1937 | Netherlands | 312/42 |
| 1036718 | 12/1962 | United Kingdom . | |

*Primary Examiner*—Peter M. Cuomo
*Assistant Examiner*—Hanh V. Tran
*Attorney, Agent, or Firm*—James C. Nemmers

[57] ABSTRACT

A dispenser for storing and dispensing small packages such as individual packages containing, for example, a single dose of a non-prescription medication. The dispenser is designed to hold and dispense a plurality of different packaged products, each of which is visibly stacked in a vertically disposed magazine where each package can be easily removed with the next package dropping by gravity to the dispensing position. The individual packages are initially contained in a disposable tray, each of which slides into one of the magazines of the dispenser with the empty tray being removed from the magazine and discarded once all of the packages have been dispensed.

7 Claims, 2 Drawing Sheets

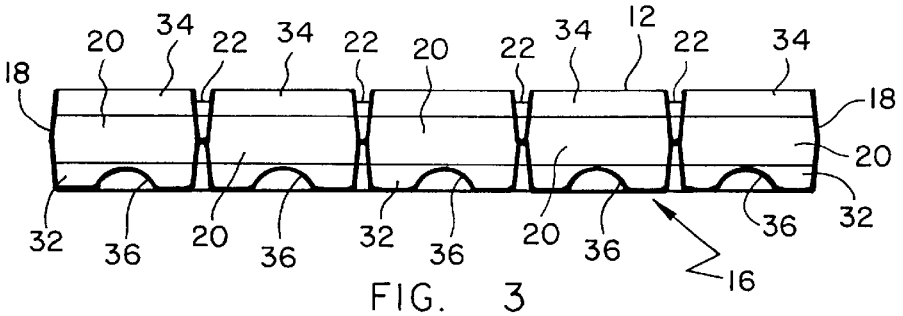
FIG. 3
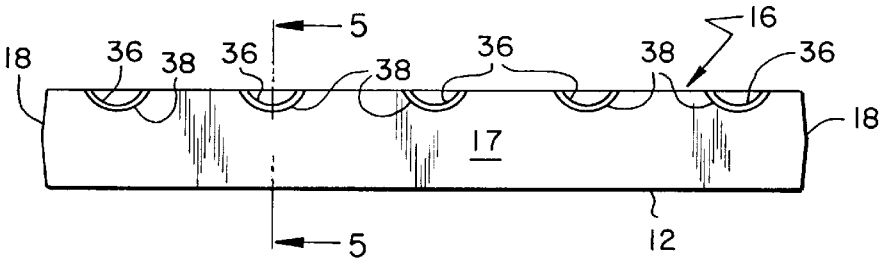
FIG. 4
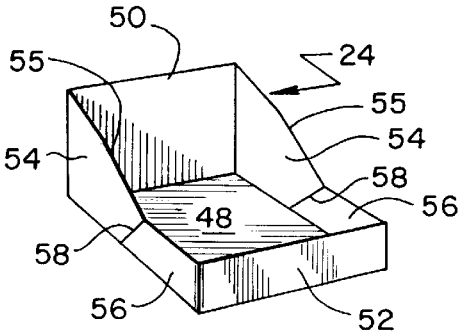
FIG. 6
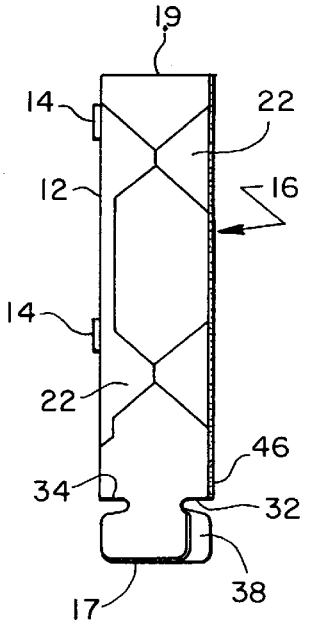
FIG. 5
FIG. 8
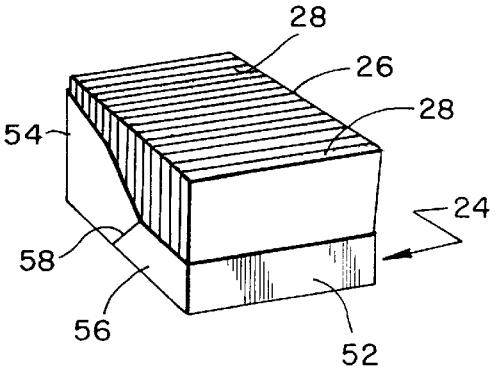
FIG. 7
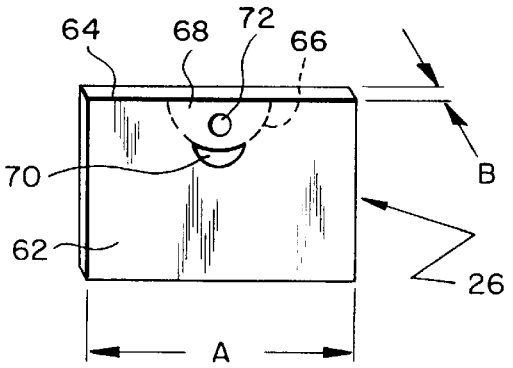

PACKAGE DISPENSER

BACKGROUND OF THE INVENTION

Over the counter and non-prescription medications are currently available in individual packages containing a single dose of one or two tablets, capsules, caplets, etc. To facilitate the display, storage and dispensing of these individual packages, dispensers are used and positioned at a location to be readily available and convenient to a consumer. This type of dispenser is of the non-coin operated type and is preferably located near the check out counter or in the health and beauty section of a retail establishment A currently known and commercially used dispenser of this type is shown in U.S. Pat. No. 4,767,022 entitled "Packet Dispenser". The dispenser of this prior patent is designed to efficiently dispense packages of medications containing a single dose of the medication which is sealed in a non-rigid packet made of a suitable paper or plastic material. These dispensers have been quite successful and they are the preferred way of displaying and dispensing the packets rather than placing the individual packets loosely in a large container. The dispenser of the prior patent also provides for an attractive display of the individual packets in an organized manner, and from the retailers standpoint, these dispensers provide a quick and easy way to market these individual dose medications. The dispenser also makes it convenient for the retailer to know when the supply of a particular medication is low and thus facilitates refilling the dispenser.

Because of the non-standard size and shapes of packages for the various products provided by different manufacturers, and because the non-rigid packaging does not always provide adequate protection to the individual tablets or capsules, individualized single dose paperboard packages of a standard size and shape and of a more rigid material would have advantages over the existing packets and dispensers. A standardized package can be used to contain a single dose of one or two capsules or tablets regardless of the varying size and shape of the individual medications. This type of standardized package is also easier to handle, provides better product protection and allows easy identification of the medication in a proper dispenser as well as providing for a more attractive display of the individual products. Moreover, such packages can be designed so that the individual packages can, if desired, be displayed using a peg-hook or on the commonly known peg-hook display rack. Such packages also facilitate printing of a UPC bar code on the package.

Therefore, an improved individual package and improved dispenser for storing, displaying and dispensing the packages will facilitate not only sales of the individual products, but will also provide for ease of use by the consumer and retailer as well.

SUMMARY OF THE INVENTION

The dispenser of the invention consists of a housing containing one or more vertically disposed magazines each of which has an open front face that terminates in a dispensing area at the lower end of the magazine. For ease of handling, individual box-shaped packages are pre-packaged in open top trays that are dropped into one of the magazines so that the open top of the tray faces forwardly. When the tray containing the individual packages is inserted into the magazine, it drops to the bottom of the magazine where it is supported on a ledge. When a consumer wishes to remove a package from the dispenser, he or she positions a finger in a hole in the ledge to engage the bottom of the package, lift the package over a lip on the front of the housing and easily remove it from the dispenser. The next package will then drop by gravity into the dispensing position. The design of the open front of each magazine is such that only a single package can be removed at a time while allowing an empty tray to be removed through the dispensing opening.

BRIEF DESCRIPTION OF THE DRAWING

FIG. 3 is a sectional view taken on the line 3—3 of FIG. 1 and showing the interior construction of the magazines;

FIG. 4 is a bottom view of the dispenser;

FIG. 5 is a sectional view taken on the line 5—5 of FIG. 4 and showing the interior construction of the dispenser;

FIG. 6 is a perspective view of an empty package tray;

FIG. 7 is a perspective view of a package tray filled with packages; and

FIG. 8 is a perspective view of the rear of an individual package and showing in dotted lines the opening tab which also serves as a hanger for the individual package.

DESCRIPTION OF THE PREFERRED EMBODIMENT OF THE INVENTION

Figure 1:
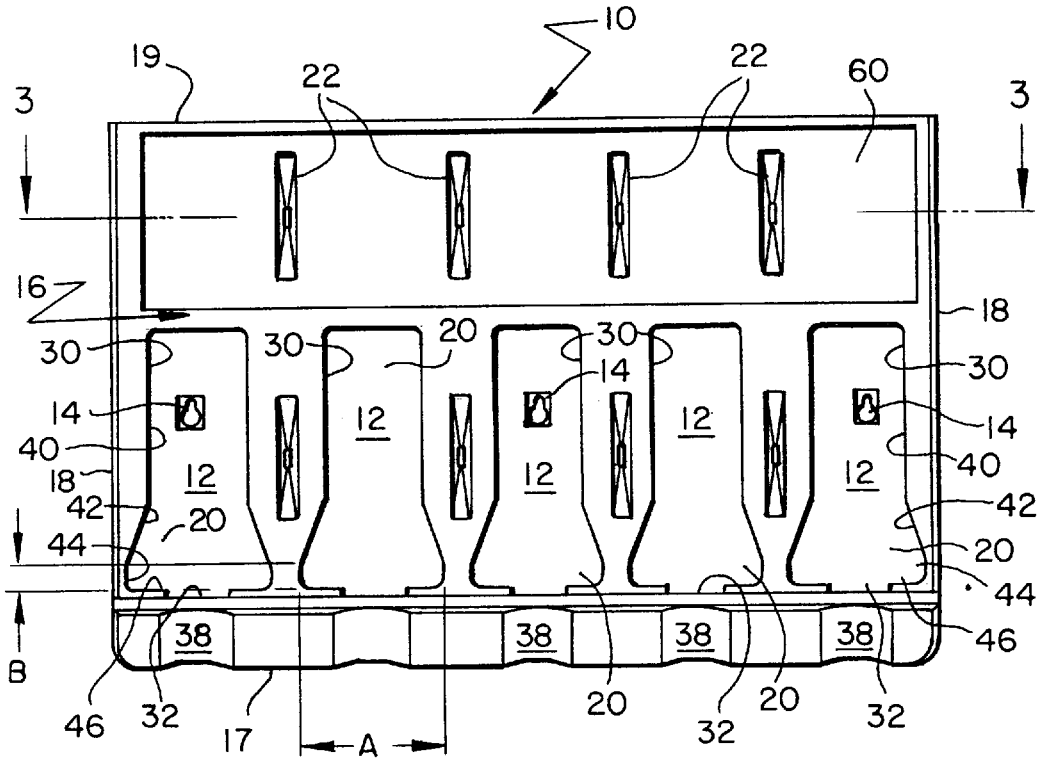
FIG. 1 is a front elevational view of a dispenser constructed according to the principles of the invention and showing each of the dispensing magazines empty.
Figure 2:
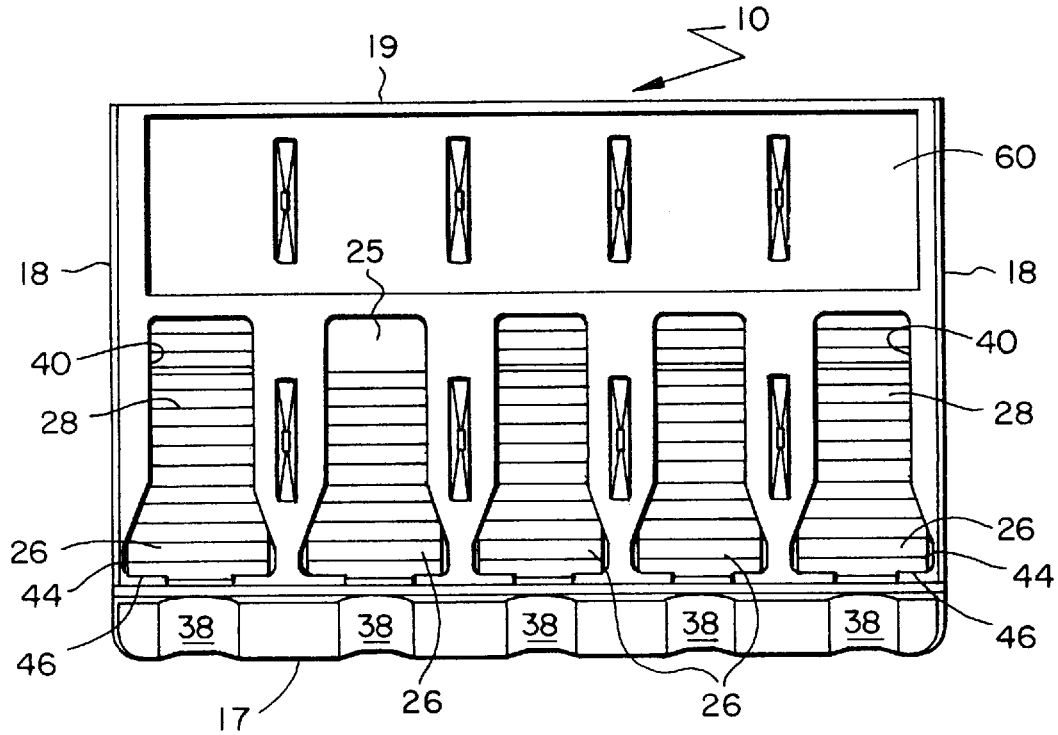
FIG. 2 is a front elevational view of the dispenser with the trays containing the individual packages shown in place in the magazines.

In FIGS. 1 and 2 there are shown front views of a unit for storing, displaying and dispensing individual packages or containers of products such as single doses of non-prescription medications such as headache remedies, allergy and cold remedies, etc. FIG. 1 shows the dispenser empty while FIG. 2 shows the magazines of the dispenser filled with trays containing the individual packages. The dispenser 10 has a rear wall 12 containing hook eyes 14 so that the dispenser 10 can be mounted on a wall, peg hook, etc. in a desired location of an establishment frequented by members of the general public. Generally, these dispensers are located near the check-out counter or in the health and beauty section of retail establishments of all types. A front wall indicated generally by the reference numeral 16 is spaced from the rear wall 12 by a bottom 17 and two side walls 18 to form a generally hollow interior that is divided into a plurality of vertical magazines 20 by dividers 22. The magazines 20 are generally rectangular in shape and are dimensioned so as to receive trays 24 (see FIGS. 6–8) that carry a plurality of box-shaped individual packages 26 of the desired product. The dispenser 10 thus has an open top 19 although a cover (not shown) could be placed over the open top 19 if desired. The packages 26 contain the tablets, capsules, caplets, etc. individually sealed in paper or polyethylene packets in a manner well known to those skilled in the art The individual packages 26 are stacked within the trays 24 so that a product identification name or trademark will be visible along the front edge 28 of each package.

Each of the magazines 20 has an opening 30 in the front wall 16, opening 30 extending downwardly from generally the middle area of the front wall 16 to a front ledge 32. Formed in the rear wall 12 at the same level as the front ledge 32 is a rear ledge 34 (FIG. 5). The ledges 32 and 34 provide a stop and support for a tray 24 filled with packages 26 when it is dropped into the open top 19 of the dispenser 10. The front ledge 32 has formed in it an opening or curved recess 36, and the lower most portion of the front wall 16 is correspondingly recessed beneath each magazine 20 to also form a recess 38. The purpose of recesses 36 and 38 will be evident from the description hereinafter of the use of the dispenser 10.

As best seen in FIGS. 1 and 2, the opening 30 in the front wall 16 has an upper portion 40 that is narrower in width than the width of the magazine 20, The upper portion 40 may extend a desired length so as to clearly display the individual packages 26 and the identifying marking on their front edges 28. If extended, the upper portion is preferably substantially of uniform width. The lower portion 42 of the opening 30 diverges outwardly from the upper portion 40 to form a dispensing opening 44 at its lowest end just above the recess 36 in the front ledge 32. The width "A" and height "B" (see FIG. 1) of the dispensing opening 44 are just slightly larger than the width "A" and height "B" (see FIG. 8) of a package 26. A lip 46 extends upwardly toward the dispensing opening 44 and inwardly from each edge of the dispensing opening 44 terminating at the recess 36. The lip 46 also may extend completely across and beneath the opening 44, but the preferred construction is that shown in the drawings.

Thus, when a tray 24 containing a plurality of packages 26 is inserted in a magazine 20, the tray 24 will drop until the tray 24 is stopped by and supported on the ledges 32 and 34. In this position, the lowermost one of the packages 26 will rest on the front ledge 32 and extend over the recesses 36 and 38. However, the lowermost of the packages 26 will not fall out of the dispenser 10 because of the lip 46. To remove a single package 26, the user places a finger in the recesses 36 and 38 and engages the bottom of the lowermost one of the packages 26, raises the package 26 a sufficient amount to clear the lip 46, and then grasps and removes the package 26 through the dispensing opening 44 of the dispenser 10. The other packages 26 contained in the tray 24 inside of the magazine 20 will be retained in place in the dispenser 10 by reason of the narrowing shape of the lower portion 42 of the opening 30.

As best seen in FIGS. 6 and 7, each tray 24 has a bottom wall 48, a rear wall 50 of substantially the same height as the height of a package 26, a front wall 52 less than half the height of a package 26 and side walls 54 that extend downwardly to a point approximately two-thirds of the way toward the front wall 52 at which point the front portion 56 of each side wall 54 is of approximately the same height as the front wall 52. Each of the side walls 54 is also preferably scored along a score line 58 that extends from the point where the front portion 56 of the side wall joins with the tapered portion 55, the score line 58 extending downwardly to the bottom wall 48 and toward the rear wall 50. The width of the tray 24 is slightly larger than the width of the package 26, and the length of the tray 24 is such as to contain a predetermined number of the packages 26 so that they are loosely contained within the tray 24. With this construction of the tray 24, a tray 24 filled with packages 26 can be easily carried to the dispenser 10 and dropped into a magazine 20 with the front wall 52 facing downwardly and the open top of the tray 24 facing forwardly. The tray 24 containing the packages 26 will fall by gravity easily down to the bottom of the magazine until the lowermost of the packages 26 rests on the front ledge 32 with the front wall 52 of the tray 24 resting on the rear ledge 34. Preferably, the length of each tray 24 is less than the height of the opening 30, and the total height of the magazine 20 is such as to contain two trays 24. This is so that the retailer displaying the dispenser 10 can quickly and easily see when the lower of the two trays 24 in a magazine is empty so that it can be removed which will create a void area 25 above the second tray after it drops down to the bottom of the magazine 20. This is shown in the second from left magazine 20 in FIG. 2 and alerts the retailer to place a second tray in the magazine so that product will always be readily available for dispensing.

The score lines 58 on the tray 24 are provided so that the tray 24 can be readily and easily collapsed for removal through the bottom portion 42 of the opening 30 as soon as all the packages 26 have been dispensed from that tray. This allows the second tray to drop into dispensing position.

In FIG. 8 there is illustrated the rear panel 62 of one of the packages 26. Formed in the rear panel 62 near the top edge 64 is a semi-circular score line 66 that creates a tab 68 beneath which is a small opening 70. This facilitates opening of the package 26 by the user by inserting the tip of a finger into opening 70 so that the tab 68 can be grasped and pulled upwardly and outwardly to open the package. Also, if desired, an opening 72 can be provided in the tab 68 so that the individual packages 26 can be hung on a peg hook for display if the dispenser 10 is not used.

The dispenser 10 is preferably molded from a rigid lightweight plastic so that it will have a long life, be easy to handle, and attractive in appearance while capable of being manufactured at a reasonable cost The upper portion 60 of the front wall 16 of dispenser 10 provides a means for retaining the upper ones of trays 24 in place in the magazines 20, but also provides a panel that may be used for identifying or advertising material.

The use of the dispenser should be evident from the foregoing description but is summarized as follows. With the magazines 20 of the dispenser 10 empty, the retailer will insert two trays 24 containing packages 26 of the desired product into each magazine 20. As previously indicated, the first tray 24 will drop to the bottom of the magazine 20 with the lowermost of the packages 26 resting on the front ledge 32 ready for dispensing through the dispensing opening 44. When it is desired to remove a package of one of the products contained in the dispenser 10, the user merely places a finger into the recesses 36 and 38 to engages the bottom of the lowermost of the packages 26. The user then raises the package 26 over the lip 46 and grasps it with a thumb and finger and pulls it through the dispensing opening 44. The design and shape of the opening 30 will prevent more than one package 26 from being dispensed at a time. Once the lowermost one of the packages 26 is completely removed from the dispenser 10, the next package 26 will drop into dispensing position. When the lower tray 24 is empty, the retailer can grasp front wall 52 of the empty tray 24, collapse it along the score lines 58, pull it through the lower portion 42 of the opening 30 and dispose of it The second filled tray 24 will then drop into dispensing position and create a void visible above it through the upper portion 40 of opening 30 alerting the retailer to place another tray in the top of the magazine 20. The dispenser 10 of the invention thus provides a convenient, attractive and functional dispenser for dispensing packages of products such as single dose non-prescription medications. It is easy for the consumer to use and easy for the retailer to maintain.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. A dispenser for storing, displaying and manually dispensing individual box-shaped packages, said dispenser comprising: a housing having a generally vertically extending rear wall and a generally vertically extending front wall spaced from the rear wall to form an open space between the walls, dividers spaced apart between the front and rear walls to form within the open space of the dispenser one or more vertically-extending magazines each throughout its length being substantially uniform in width and uniform in depth and adapted to receive one or more box-shaped packages to be stored and dispensed, each magazine having an opening in the front wall that defines a dispensing opening at the lower end of the magazine, a support at the lower end of each magazine near the dispensing opening adapted to support a plurality of packages in a stacked relationship in a magazine, a lip extending across the lowest portion of the dispensing opening and having a top edge extending above the support, the width of the dispensing opening being greater than the width of a package to be contained in the magazine and the height of the dispensing opening above the top edge of the lip being greater than the height of a single package, a recess in the support and extending toward but not into the back wall to provide for manual lifting of a lowermost package resting on the support over the lip and through the dispensing opening, the front wall having an upper part above the dispensing opening and a lower part below the dispensing opening, and the lower part of the front wall having a recess beneath the recess in the support at the lower end of each magazine.

2. The dispenser of claim 1 which the upper part of the front wall includes an area providing a panel for identifying material.

3. A dispenser for storing, displaying and manually dispensing individual box-shaped packages, said dispenser comprising: a housing having a generally vertically extending rear wall and a generally vertically extending front wall spaced from the rear wall to form an open space between the walls, dividers spaced apart between the front and rear walls to form within the open space of the dispenser one or more vertically-extending magazines each adapted to receive the packages to be stored and dispensed, each magazine having an opening in the front wall that defines a dispensing opening at the lower end of the magazine, a support at the lower end of each magazine near the dispensing opening adapted to support a plurality of packages in a stacked relationship in the magazine, a lip extending across the lowest portion of the dispensing opening at a position above the support, a recess in the front wall beneath the lip to provide for manual lifting of a lowermost package stored in a magazine over the lip and through the dispensing opening, and an open-top tray adapted to receive and hold a plurality of said packages in a stacked relationship within the tray, the tray having a bottom wall, a rear wall, a front wall the height of which is substantially less than the height of the rear wall, and spaced apart side walls joining the front wall and rear wall, the side walls at their juncture with the front wall being of a height substantially the same as the front wall so that the tray when empty can pass through the dispensing opening, the tray being removably received in one of said magazines with the open top of the tray facing forwardly so that packages in the tray are visible through the opening in the front wall of the dispenser, the support at the lower end of each magazine positioning the tray in the magazine with the lowest one of the packages in the tray being positioned behind the lip.

4. The dispenser of claim 3 in which the side walls of the tray are scored between the front wall and the rear wall to provide for collapsing of the tray to facilitate its removal from the magazine when the tray is empty.

5. The dispenser of claim 3 which the height of one of said magazines is greater than twice the length of a tray between the tray's front wall and rear wall, and the opening in the front wall of the dispenser is greater than the length of a tray so that a first tray positioned in a magazine and a portion of a second tray on top of the first tray are both visible through the opening in the front wall of the dispenser.

6. A dispenser for storing, displaying and manually dispensing individual box-shaped packages, said dispenser comprising: a housing having a generally vertically extending rear wall and a generally vertically extending front wall spaced from the rear wall to form an open space between the walls, dividers spaced apart between the front and rear walls to form within the open space of the dispenser one or more vertically-extending magazines each throughout its length being substantially uniform in width and uniform in depth and adapted to receive one or more box-shaped packages to be stored and dispensed, each magazine having an opening in the front wall that defines a dispensing opening at the lower end of the magazine, a support at the lower end of each magazine near the dispensing opening adapted to support a plurality of packages in a stacked relationship in the magazine, a lip extending across the lowest portion of the dispensing opening at a position above the support, a recess in the front wall beneath the lip to provide for manual lifting of a lowermost package stored in a magazine over the lip and through the dispensing opening, an open-top tray adapted to receive and hold a plurality of said packages in a stacked relationship within the tray, the tray being removably received in one of said magazines with the open top of the tray facing forwardly so that packages in the tray are visible through the opening in the front wall of the dispenser, the support at the lower end of each magazine positioning the tray in the magazine with the lowest one of the packages in the tray being positioned behind the lip, and the tray having a bottom wall, a rear wall, a front wall the height of which is substantially less than the height of the rear wall, and spaced apart side walls joining the front wall and rear wall, the side walls being at a height substantially the same as the front wall from the front wall to a point generally midway between the front wall and rear wall and then extending upwardly to the height of the rear wall so that the tray when empty can be passed through the dispensing opening.

7. The dispenser of claim 6 in which the side walls of the tray are scored between the front wall and the rear wall to provide for collapsing of the tray to facilitate its removal from the magazine when the tray is empty.

* * * * *